US005842901A

United States Patent [19]

Montgomery

[11] Patent Number: 5,842,901

[45] Date of Patent: Dec. 1, 1998

[54] BABY BOTTLE WITH MUSICAL AND VIBRATORY ADAPTERS

[76] Inventor: Lonzell Montgomery, 418 Central Park West, #85, New York, N.Y. 10025

[21] Appl. No.: 784,520

[22] Filed: Jan. 17, 1997

[51] Int. Cl.[6] ..... A61J 9/00

[52] U.S. Cl. ..... 446/77; 446/81; 215/11.1

[58] Field of Search ..... 446/77, 81, 267, 446/397; 215/11.1, 11.6

[56] References Cited

U.S. PATENT DOCUMENTS

| | | | |
|---|---|---|---|
| 1,434,460 | 11/1922 | Tibbats | 215/11.1 |
| 1,622,512 | 3/1927 | Holladay | 215/11.1 |
| 2,929,290 | 3/1960 | Smith | 215/11.6 |
| 3,093,256 | 6/1963 | Woodbury | 215/11.1 |
| 3,627,161 | 12/1971 | Wergeland | 446/81 |
| 3,805,440 | 4/1974 | Becker . | |
| 4,703,863 | 11/1987 | Kohus | 215/11.1 |
| 4,850,496 | 7/1989 | Rudell et al. | 215/12.1 |
| 4,944,704 | 7/1990 | Grace | 446/74 |
| 5,125,866 | 6/1992 | Arad et al. | 446/397 |
| 5,401,200 | 3/1995 | Ellis | 446/71 |

FOREIGN PATENT DOCUMENTS

| | | | |
|---|---|---|---|
| 1358543 | 3/1964 | France | 446/397 |

*Primary Examiner*—Robert A. Hafer
*Assistant Examiner*—Laura Fossum
*Attorney, Agent, or Firm*—H. Jay Spiegel

[57] ABSTRACT

A baby bottle is provided with adapter structure allowing selective attachment of a music box and/or a vibrator. Each device has its own independent power source and the adapters have structure allowing them to be attached to the bottom of the baby bottle in multiple orientations.

12 Claims, 3 Drawing Sheets

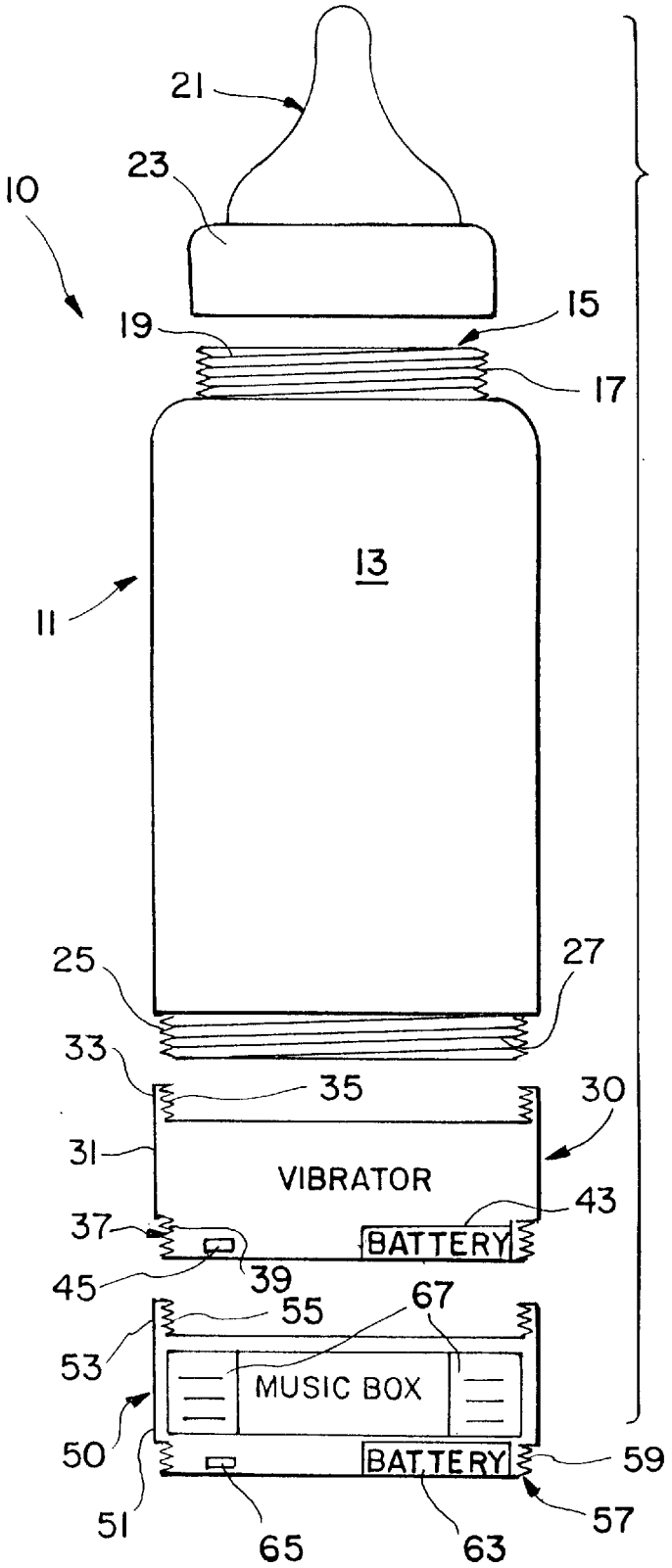
FIG. 1
FIG. 2
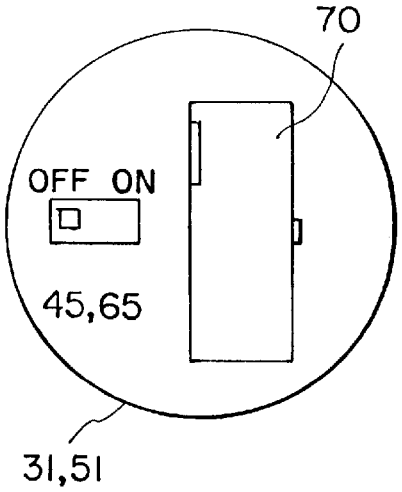

BABY BOTTLE WITH MUSICAL AND VIBRATORY ADAPTERS

BACKGROUND OF THE INVENTION

The present invention relates to a baby bottle with musical and vibratory adapters. In the prior art, baby bottles are well known as are baby bottles having music producing adapters attached thereto. Additionally, devices including dispensers having vibration means associated therewith are also known. However, Applicant is unaware of any prior art device teaching the combination of a baby bottle with both a vibratory adapter and a musical adapter. Applicant is further unaware of any prior art device teaching adapter structure allowing a vibratory device and a musical device to be attached to the bottom of a baby bottle with either the musical device or the vibratory device adjacent the baby bottle.

The following prior art is known to Applicant:

U.S. Pat. No. 2,369,881 to Berns et al.

U.S. Pat. No. 2,929,290 to Smith

U.S. Pat. No. 3,199,730 to Young, Jr. et al.

U.S. Pat. No. 3,499,578 to O'Neal

U.S. Pat. No. 3,627,161 to Wergeland

U.S. Pat. No. 4,537,109 to Sakurai

U.S. Pat. No. 4,678,093 to Allen

U.S. Pat. No. 4,740,196 to Powell

U.S. Pat. No. 4,898,060 to To

U.S. Pat. No. 5,344,034 to Eagan.

Of the above-listed references, Smith, Young, Jr. et al., Wergeland, Sakurai, Allen, To, and Eagan each teach a baby bottle or other container associated with a music producing device. Berns et al. and O'Neal teach dispensers combined with vibration means while Powell discloses a vibration device combined with a device for stimulating lactation in the female human breast.

None of these references teaches the combination of a baby bottle with both vibratory and musical adapters nor the exchangeability of orientation as described above.

SUMMARY OF THE INVENTION

The present invention relates to a baby bottle with musical and vibratory adapters. The present invention includes the following interrelated objects, aspects and features:

(1) In a first aspect, the present invention is intended to be in association with a baby bottle having an upper opening with an exteriorly threaded fitting to which a nipple may be threadably mounted. In the preferred embodiment of the present invention, the typical baby bottle is modified through the addition of a fitting on the bottom thereof that is also exteriorly threaded.

(2) A means for generating vibrations comprising a vibratory adapter and a means for playing musical programs comprising a music box adapter are provided. Each of these devices has an identical housing that includes an upper fitting with internal threads designed to enmesh with the exterior threads of the bottom fitting of the bottle and each such housing includes a lower fitting having exterior threads designed to enmesh with the interior threads of the upper fitting of the other housing. In this way, the vibratory adapter and music box adapter may be coupled together with either one above the other and either or both adapters may be coupled to the bottom fitting of the baby bottle.

(3) The music box adapter may include a music box of the mechanical type or one wherein a musical sequence is pre-recorded on a computer chip. The latter type is preferred since it will be less likely to have its functions disrupted when played while the vibratory adapter is activated.

(4) The vibratory adapter may include a vibration device of any suitable type such as a motor driving an oscillating member through gears or a belt, an electronic chip designed to resonate at a low frequency, or any suitable alternative means.

Accordingly, it is a first object of the present invention to provide a baby bottle with musical and vibratory adapters.

It is a further object of the present invention to provide such a device including modifications to a typical baby bottle allowing attachment thereto of the respective adapters.

It is a still further object of the present invention to provide such a device including adapter housing structure allowing attachment of the vibratory and musical adapters with either one adjacent the bottom of the baby bottle.

These and other objects, aspects and features of the present invention will be better understood from the following detailed description of the preferred embodiment when read in conjunction with the appended drawing figures.

BRIEF DESCRIPTION OF THE DRAWINGS

FIG. 1 shows an exploded side view, partially in cross-section, of the present invention.

FIG. 2 shows a bottom view of either one of the adapters included in the present invention.

SPECIFIC DESCRIPTION OF THE PREFERRED EMBODIMENT

Figure 3:
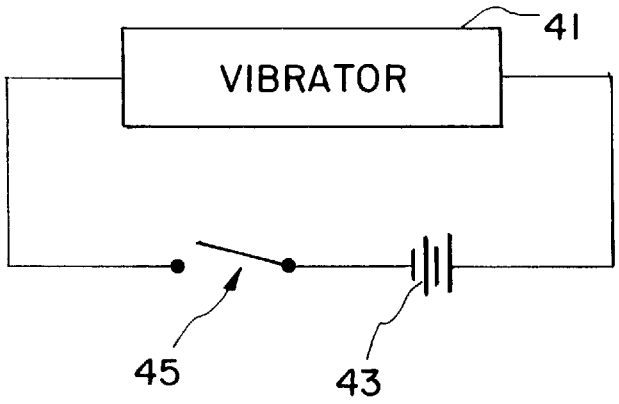
FIG. 3 shows a schematic representation of the electrical circuitry for the vibratory adapter.

With reference, first, to FIG. 1, the present invention is generally designated by the reference numeral 10 and is seen to include a baby bottle 11 having a body 13 having an upper opening 15 and an upper fitting 17 surrounding the opening 15 and having exterior threads 19. A nipple 21 has a fitting 23 with internal threads (not shown) sized and configured to enmesh with the threads 19 of the upper fitting 17 of the bottle 11 so that the nipple 21 may be suitably affixed to the bottle 11.

With further reference to FIG. 1, it is seen that the bottle 11 has a lower fitting 25 with exterior threads 27 for a purpose to be described in greater detail hereinafter.

With further reference to FIG. 1, the present invention also includes a vibratory adapter 30 and a musical adapter 50. The vibratory adapter 30 includes a housing 31 with an upper fitting 33 having internal threads 35 sized and configured to enmesh with the exterior threads 27 of the lower fitting 25 of the bottle 11. The housing 31 also includes a lower fitting 37 having exterior threads 39 for a purpose to be described in greater detail hereinafter. Within the housing 31, a vibrator 41 is contained. The vibrator 41 is schematically represented in FIG. 3. With reference back to FIG. 1, the housing 31 also contains a battery 43 and has a switch 45 accessible from outside the housing 31 to allow activation and deactivation of the vibrator 41. The battery 43 and switch 45 are also schematically represented in FIG. 3.

Figure 4:
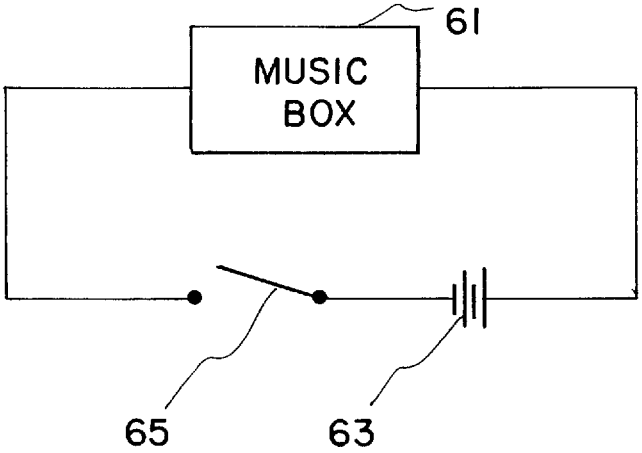
FIG. 4 shows a schematic representation of the electrical circuitry of the musical adapter.

With further reference to FIG. 1, the musical adapter 50 includes a housing 51 identical to the housing 31, an upper fitting 53 identical to the upper fitting 33 of the housing 31, the upper fitting 53 having internal threads 55 identical to the internal threads 35 of the housing 31, and the housing 51 further includes a lower fitting 57 identical to the lower fitting 37 of the housing 31, with the lower fitting 57 having exterior threads 59 identical to the threads 39 of the fitting 37 of the housing 31. Within the housing 51, a music box 61 is provided as schematically represented in FIG. 4. Also schematically represented in FIG. 4 are the battery 63 and the on-off switch 65 which are also shown in FIG. 1. The housing 51 includes the further provision of grills 67 provided to allow musical sounds to emanate from the housing 51.

The threads 55, as should now be evident, are sized and configured to enmesh with the threads 27 of the lower fitting 25 of the bottle 11. Similarly, the threads 55 are sized and configured to enmesh with the exterior threads 39 of the lower fitting 37 of the housing 31. Similarly, the threads 35 of the upper fitting 33 of the housing 31 are sized and configured to enmesh with the threads 59 of the lower fitting 57 of the housing 51. In this way, the housing 31 may be assembled to the lower fitting 25 of the bottle 11 or, alternatively, may be assembled to the lower fitting 57 of the housing 51. Thus, the vibratory adapter 30 may be affixed to the bottle 11 directly or may be affixed to the musical adapter 50 which is affixed to the bottle 11. Alternatively, the musical adapter 50 may be affixed to the bottle 11 with the vibratory adapter 30 affixed thereto. Alternatively, either of the adapters 30 or 50 may be individually affixed to the bottle 11. As should now be understood, this interchangeability of components gives great versatility to the present invention.

FIG. 2 shows a bottom view of either the housing 31 or the housing 51 and depicts an access door 70 allowing access to either the battery 43 or 63. The on-off switch 45 or 65 is also shown.

Figure 5:
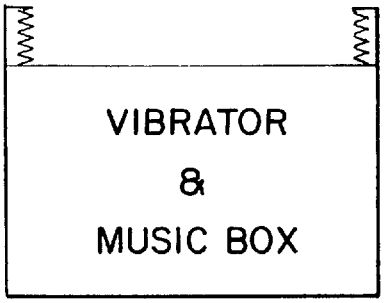
FIG. 5 shows a side view, partially in cross-section, of a housing containing both the vibrator and the music box.

In the preferred embodiment of the present invention, the housings 31 and 51 may be made of any suitable material such as, for example, molded plastic. As explained above, the music box 61 may be of the mechanical type or of a type wherein musical sounds are programmed onto a computer chip for selective replay. The vibrator 41 may be of any type including the type wherein a low frequency sound is programmed into a computer chip for replay or, alternatively, a mechanical vibrator which includes a motor operating an oscillating member through mechanical coupling means such as gears or a belt and pulleys. If desired, the music box and vibrator may be contained within a single housing of the size of either or both of the housings 31, 51, which single housing includes a fitting such as the fitting 33 or 53 allowing attachment to the fitting 25 of the bottle 11. See FIG. 5.

Figure 6:
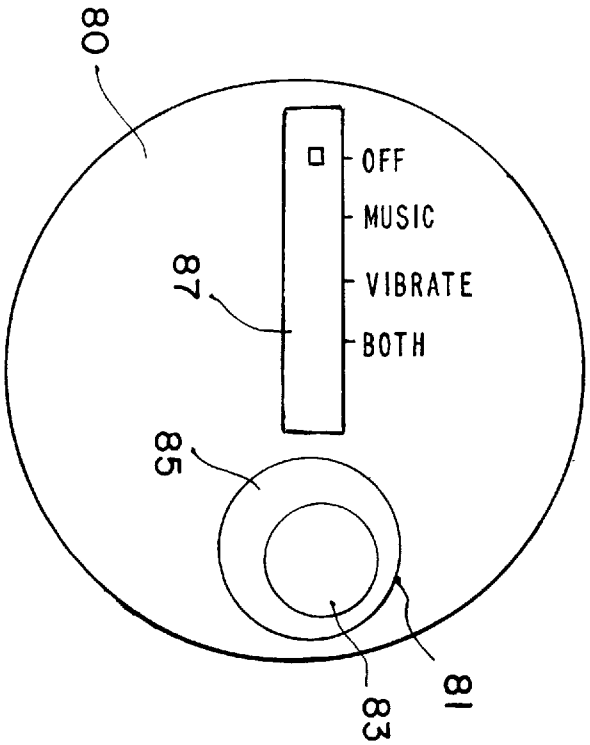
FIG. 6 shows a bottom view similar to that of FIG. 2 but depicting an alternative construction.
Figure 7:
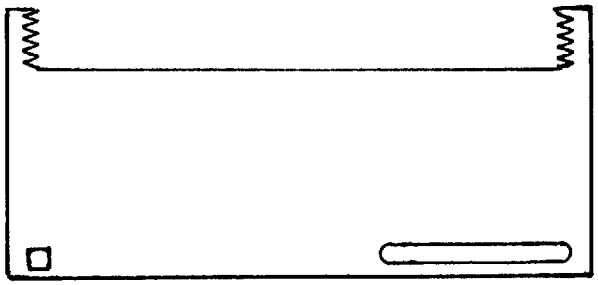
FIG. 7 shows a perspective view of the present invention.

As pointed out above, the music box and vibrator may be contained within a single housing. With reference to FIG. 6, in such event, the bottom of the housing would be as shown in FIG. 6 as designated by the reference numeral 80 and including a generally circular access opening 81 defining a chamber receiving a battery 83, which opening 81 is closed by an access door 85. A switch 87 is provided and includes positions for "off", music only, vibrate only, and both music and vibration. Such a switch is well known to those skilled in the art. With reference back to FIG. 2, where the music box and vibrator are combined into a common housing, the common housing could be made of a size equivalent to one of the housings 31 or 51.

As such, an invention has been disclosed in terms of a preferred embodiment thereof which fulfills each and every one of the objects of the invention as set forth hereinabove and provides a new and useful baby bottle with musical and vibratory adapters of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A baby bottle, comprising:

a) a body having an internal fluid-receiving chamber with an upper opening closed by a nipple, said body having a bottom terminus carrying a first lower fitting;

b) a musical adapter including a body with a first upper fitting releasably attachable to said first lower fitting, and said musical adapter including a second lower fitting, said musical adapter including means for playing musical programs; and c) a vibratory adapter including a body with a second upper fitting releasably attachable to said first or second lower fitting, said vibratory adapter including means for generating vibrations.

2. The bottle of claim 1, wherein said vibratory adapter body includes a third lower fitting, said first upper fitting being releasably attachable to either said first or third lower fitting.

3. The bottle of claim 1, wherein each of said lower fittings is exteriorly threaded.

4. The bottle of claim 3, wherein each of said upper fittings is interiorly threaded with threads adapted to enmesh with threads of said lower fittings.

5. The bottle of claim 1, wherein said adapter bodies are made of plastic.

6. The bottle of claim 1, wherein said adapter bodies are identically shaped.

7. The bottle of claim 1, wherein each adapter includes an electric circuit having a battery and an on-off switch.

8. A baby bottle, comprising:

a) a body having an internal chamber with an upper opening closed by a nipple;

b) a musical source adapted to be releasably attached to said body; and c) a vibratory source adapted to be releasably attached to said body.

9. The bottle of claim 8, wherein said musical source and vibratory source are contained within a common housing.

10. The bottle of claim 9, wherein said body has a lower fitting to which said common housing may be releasably attached.

11. A baby bottle, comprising:

a) a body having an internal fluid-receiving chamber with an upper opening closed by a nipple, said body having a bottom terminus carrying a first lower fitting;

b) a musical adapter comprising a battery powered music box including a body with a first upper fitting releasably attachable to said first lower fitting, and said musical adapter including a second lower fitting; and c) a vibratory adapter including a body with a second upper fitting releasably attachable to said first or second lower fitting.

12. A baby bottle, comprising:

a) a body having an internal fluid-receiving chamber with an upper opening closed by a nipple, said body having a bottom terminus carrying a first lower fitting;

b) a musical adapter including a body with a first upper fitting releasably attachable to said first lower fitting, and said musical adapter including a second lower fitting; and c) a vibratory adapter comprising a battery powered vibrator including a body with a second upper fitting releasably attachable to said first or second lower fitting.

* * * * *